United States Patent [19]

Thalenfeld

[11] 4,362,249

[45] Dec. 7, 1982

[54] POSITIVE LOCKING MERCHANDISE HOOK

[75] Inventor: David R. Thalenfeld, Beechhurst, N.Y.

[73] Assignee: Trion Industries, Inc., Garden City, N.Y.

[21] Appl. No.: 160,109

[22] Filed: Jun. 16, 1980

[51] Int. Cl.[3] ..... A47F 7/00

[52] U.S. Cl. ..... 211/59.1; 248/220.4

[58] Field of Search ..... 24/59.1, 57.1, 54.1; 248/220.2, 220.3, 220.4, 221.1, 221.2

[56] References Cited

U.S. PATENT DOCUMENTS

| | | | |
|---|---|---|---|
| 354,903 | 12/1886 | Hastings . | |
| 725,678 | 4/1903 | Cullum . | |
| 2,312,985 | 3/1943 | Bales | 248/304 |
| 2,841,353 | 7/1958 | Burdick . | |
| 2,933,277 | 4/1960 | Messier . | |
| 2,987,286 | 6/1961 | Alling . | |
| 3,452,954 | 7/1969 | Lucietto et al. | |
| 3,477,677 | 11/1969 | Hindley . | |
| 3,516,634 | 6/1970 | Salava et al. | |
| 3,545,711 | 12/1970 | Scheneman . | |
| 3,897,926 | 8/1975 | Silver | 248/221.1 |
| 3,926,395 | 12/1975 | Lallement . | |
| 3,964,712 | 6/1976 | Staudte, Jr. | |
| 4,026,508 | 5/1977 | Ziegler | 211/59.1 X |

FOREIGN PATENT DOCUMENTS

| | | | |
|---|---|---|---|
| 2386718 | 12/1978 | France | 248/220.4 |
| 2412781 | 8/1979 | France | 248/220.3 |
| 1483450 | 8/1977 | United Kingdom | 248/220.4 |

*Primary Examiner*—Roy D. Frazier
*Assistant Examiner*—Robert W. Gibson, Jr.
*Attorney, Agent, or Firm*—Mandeville and Schweitzer

[57] ABSTRACT

The disclosure is directed to a positive locking merchandise hook, for mounting on perforated panel board, preventing accidental dislodgement of the hook from its mounted position. The locking feature comprises in part an upwardly extending, flexible resilient tongue which overlies the front face of the panel board. In order to mount or demount the merchandise hook, the locking tongue may be resiliently deflected by the application of a modest external force. After mounting of the unit, the flexible locking tongue is rigidly and positively supported against deflection, to prevent demounting without a specific mechanical manipulation in addition to normal movements incident to removal of the device. The positive locking feature is derived from so contouring the wire merchandise support element that, when it is placed in its working position, a portion of it bears against or least opposes the locking tongue to prevent its deflection. In general, the advantageous features are realized without consequential additional manufacturing expense.

13 Claims, 10 Drawing Figures

FIG.6
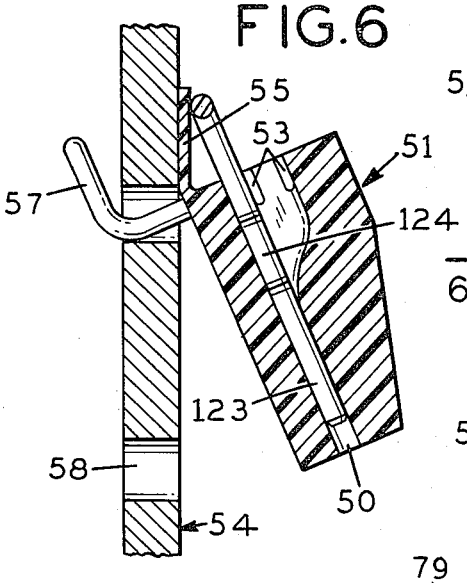
FIG.5
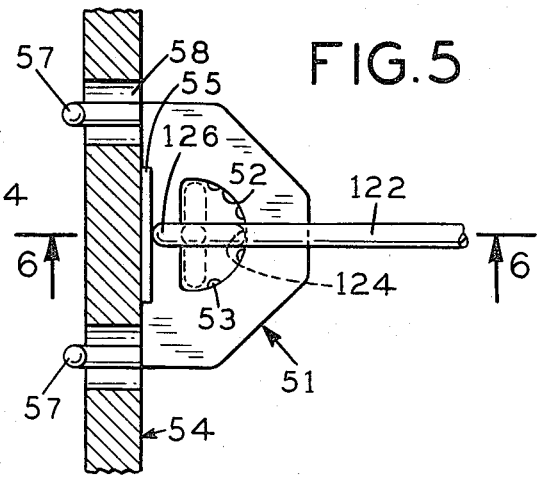
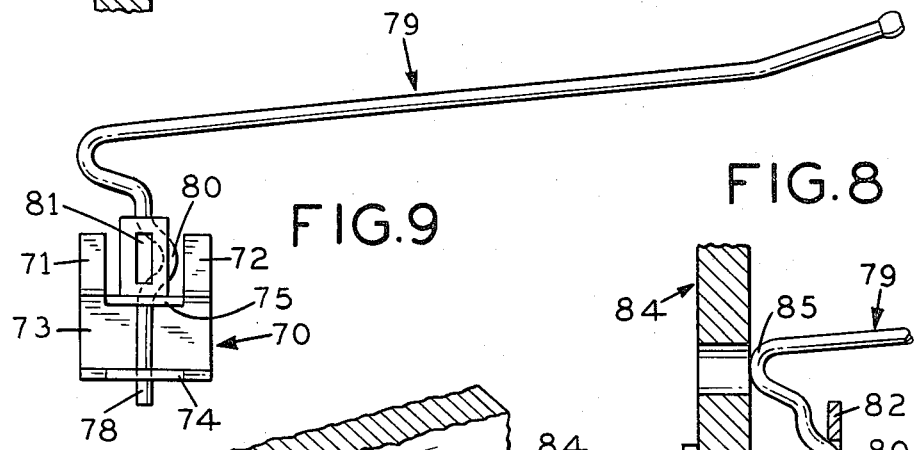
FIG.9
FIG.8
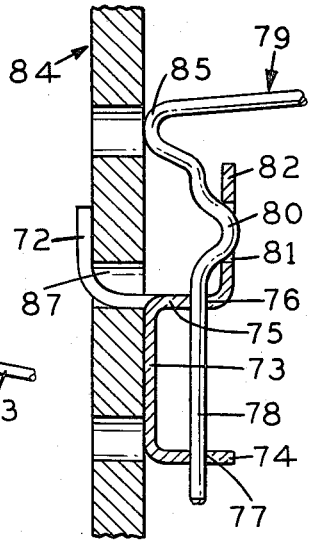
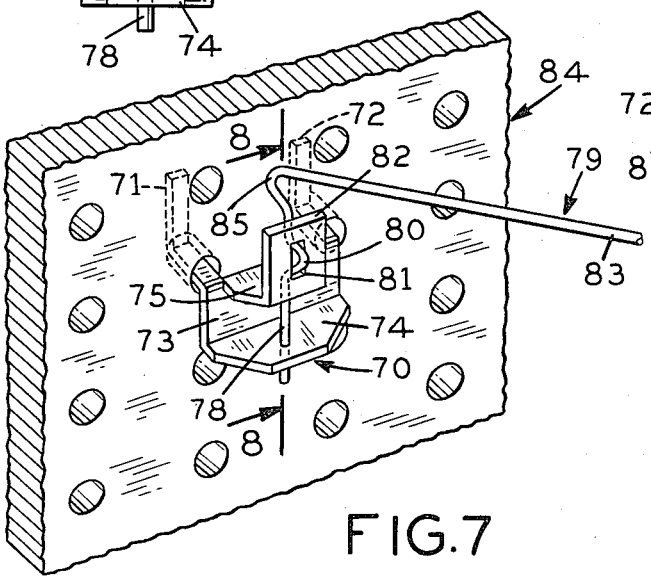
FIG.7

POSITIVE LOCKING MERCHANDISE HOOK

RELATED APPLICATIONS

This application is closely related in subject matter to my copending application Ser. No. 117,459, filed Feb. 1, 1980, for "SELF-LOCKING MERCHANDISE HOOK".

BACKGROUND AND SUMMARY OF INVENTION

The invention relates in general to display hooks for the support and display of merchandise on perforated panel board. In particular, the invention is directed to a novel and improved form of such display hooks provided with a simplified and effective means for positively locking the hook in its assembled position on the display panel.

Panel board display hooks are available in a wide variety of constructions, suitable for various specific end uses. The hook of the present invention is designed specifically for applications in which accidental dislodgement of the display hook from its mounted location may be a problem. For example, in certain types of rack jobbing merchandise plans, the panel board display units are preassembled at the factory, with the merchandise display hooks in predetermined, desirable locations on individual panel board display units. The preassembled panel and hook arrangements are shipped to the display location, where they are unpackaged and set up by the personnel of the retail outlet. As will be easily appreciated, conventional panel board hook arrangements might easily become dislodged from their preassembled locations during shipping and handling of the preassembled display, largely defeating the advantages of the factory preassembly. In addition to the above, display hooks which are relatively light in weight may easily become accidentally dislodged from their display positions at the retail outlet, as a result of accidental contact, for example. To avoid or minimize the possibility of accidental dislodgement, many panel board display hanger designs incorporate some kind of device for locking the hanger in its stalled position. Representative such arrangements are shown in the Lucietto et al. U.S. Pat. No. 3,452,954, for example. Additional examples are shown in the Staudte, Jr. U.S. Pat. No. 3,964,712, the Lallement U.S. Pat. No. 3,926,395, the Scheneman U.S. Pat. No. 3,545,711, the Salava et al. U.S. Pat. No. 3,516,634, the Hindley U.S. Pat. No. 3,477,677 and the Alling U.S. Pat. No. 2,987,286.

The present invention provides a unique and improved, highly simplified, low cost arrangement providing for positive locking of a panel board display hook assembly on a display panel. In one particularly advantageous form, the display hook of the invention provides for an upwardly extending, integral flexible tongue, along the back edge of a molded plastic base element. The configuration and location of this flexible tongue is such that it must be resiliently deflected in order to either insert the base into mounted position on the panel board or to remove it. Provision is made for insertion of a wire merchandise support hook after mounting of the plastic base on the perforated display board. The wire hook and/or the resilient tongue, according to the invention, are so contoured that a portion of the wire bears against the outer face of the integral, resilient tongue, when the wire is mounted in the plastic base. The relatively rigid wire thus serves to positively lock the base in position against dislodgement.

In a modified form of the invention, provision is made for rotatable mounting of the wire display element. The wire element is so mounted and so contoured that, in one rotational orientatio of the wire, the integral resilient tongue provided on the base member may be deflected sufficiently to enable mounting and dismounting of the display hook. After mounting of the hook, however, the hook is rotated to its normal orientation, in which a portion of the hook bears rigidly against the otherwise flexible tongue to provide a rigid, positive locking action.

In the above described modifications, in which the wire merchandise support provides a rigid locking action, the flexible tongues are useful in providing a temporary, resilient self-locking action and also by way of preventing marring of the surface of the perforated panel board.

In a modified form of the invention, the base member advantageously may be made of a single piece, stamped-out section of spring steel, for example. Provision is made for the rotatable mounting of a specially contoured wire merchandise support. When the wire element is rotated to a retracted position, adequate clearance is provided for the mounting and demounting of the base member on a display panel. After the device is mounted, the wire element is pivoted to its normal, outwardly projecting position, and locked in such position by appropriate detent means. When the wire is in this position, a portion thereof is positioned to bear upon, or closely overlie, the front face of the panel board, at a location above the openings through which the mounting lugs extend, to effectively prevent removal of the device from the panel board. The last mentioned modification of the invention may be produced at extremly low cost, to an extent such that it may be feasible in some cases for the device to be utilized a single time and then discarded. This can be advantageous for special purpose, preassembled merchandise display racks, which are received from the manufacturer preloaded with merchandise and are intended to be discarded after the merchandise has been completely sold.

For a better understanding of the above and other features and advantages of the invention, reference should be made to the following detailed description of a preferred embodiment of the invention and to the accompanying drawings.

DESCRIPTION OF THE DRAWINGS

FIG. 5 is a fragmentary top plan view of a modified form of the invention shown in FIG. 1, in which a wire merchandise support element is mounted for rotation in a plastic base member, with positive locking provided when the wire member is rotated to its normal position.

FIG. 6 is a cross sectional view as taken generally on line 6—6 of FIG. 5, but showing the wire element rotated to a retracted position, for mounting and demounting of the device.

FIG. 7 is a perspective view of a further modified form of the invention, in which the base member is formed of a single stamping of spring steel, for example.

FIG. 8 is an enlarged, fragmentary cross sectional view as taken generally on line 8—8 of FIG. 7.

FIG. 9 is a front elevational view of the device of FIG. 7, with the wire merchandise support element shown rotated to its retracted position.

DESCRIPTION OF PREFERRED EMBODIMENTS OF THE INVENTION

Figure 1:
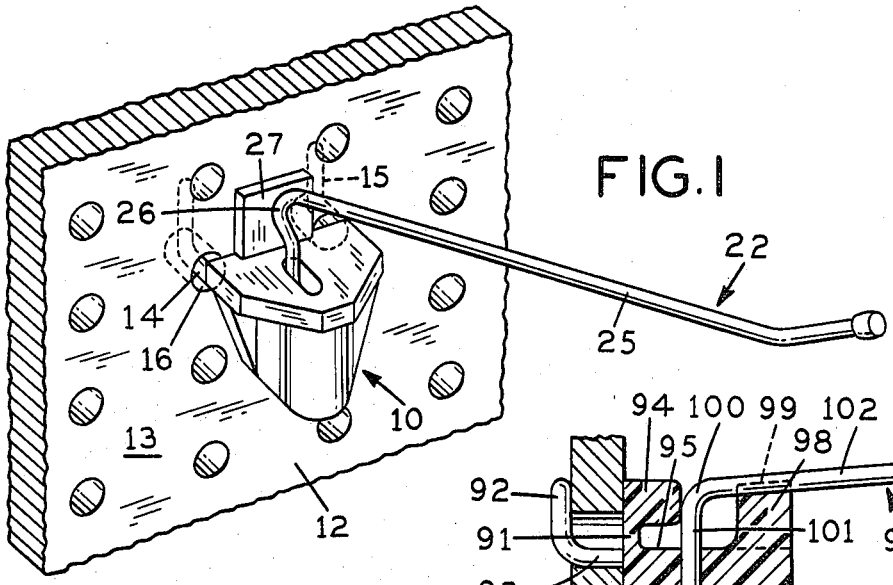
FIG. 1 is a perspective view showing a positive locking panel board display hook incorporating features of the invention, mounted on a section of perforated panel board.
Figure 2:
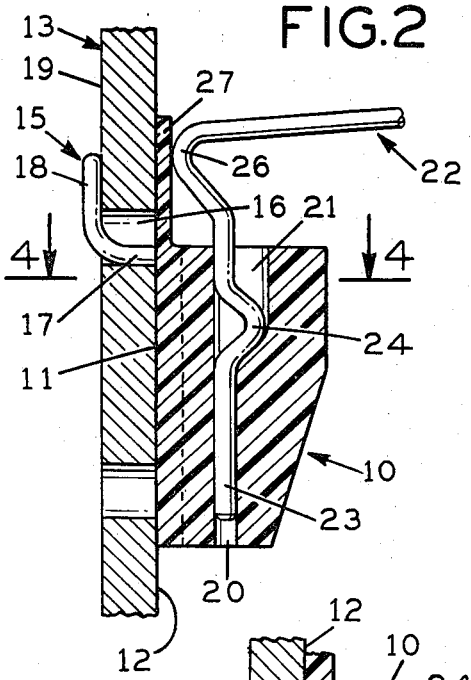
FIG. 2 is a cross sectional view of the display hook of FIG. 1, shown in position to support and display merchandise.
Figure 3:
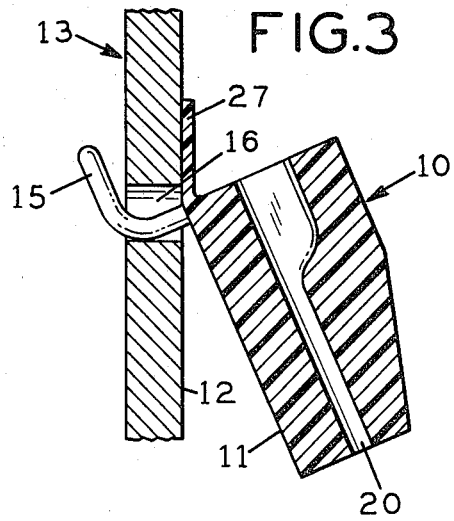
FIG. 3 is a cross sectional view showing a molded plastic base member for use in connection with a locking display hook of FIG. 1.
Figure 4:
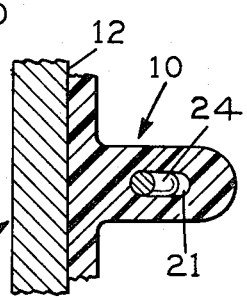
FIG. 4 is a cross sectional view taken generally along line 4—4 of FIG. 2.

Referring now to the drawings, and initially to FIGS. 1-3 thereof, the reference numeral 10 designates generally a base or mounting member for a display hook, which is formed, typically by injection molding, of a thermoplastic material. A material such as nylon, having relatively high strength and a degree of resilience, is considered to be a preferred material. However, the specific material is not critical to the invention, and it is possible that a wide variety of materials would be suitable for the purposes outlined. Typically, the back surface 11 of the base member is generally flat, adapted to be received against the front surface 12 of a standard perforated panel board 13. The base member is provided with a pair of rearwardly and upwardly extending L-shaped mounting lugs 14, 15, which extend rearwardly from the upper back edge of the base. The size and shape of the lugs 14, 15 is conventional and appropriate to be received through an adjacent pair of panel board apertures 16 such that, with the base 10 in its installed position as shown in FIG. 2, for example, the horizontal portions 17 of the lugs bear against the bottoms of the apertures 16 and the vertical portions 18 of the lugs bear against the back surface 19 of the panel board, to secure the base in its installed position.

In the form of the invention illustrated in FIGS. 1-4, the plastic base member 10 is provided with an upwardly opening cylindrical recess 20, joined at its upper end with an upwardly opening slot 21. An elongated wire merchandise support wire 22 is provided at its inner end with a downwardly projecting leg 23, which is arranged to be received snugly in the cylindrical socket 20. The upwardly opening slot portion 21 of the base is arranged to receive a forward excursion 24 of the wire support member, which forms an orientation lug for maintaining the merchandise support section 25 of the support member oriented at a predetermined angle (typically 90 degrees) to the panel board 13.

As shown particularly in FIG. 2, the mounting portion of the wire 22 is provided with a rearwardly bent excursion 26 forming a locking lug. Pursuant to the invention, the locking lug has portions which lie closely adjacent the front face 12 of the panel board, at a location somewhat above the panel board openings 16 through which the mounting lugs 14, 15 are received. Accordingly, when the wire support member 22 is mounted within the recess 21 of the plastic base member, it is positively locked against the necessary upward tilting movement (see FIG. 3) required to demount the base from the panel board.

To advantage, in the first illustrated form of the invention, the plastic base member 10 may be conveniently provided with an upwardly extending, integral flexible tongue 27 which extends upward and is interposed between the locking lug 26 and the front surface 12 of the panel board. The presence of the flexible tongue 27 prevents any marring of the surface of the panel board by the metal locking lug 26.

An additional benefit of the flexible tongue 27 resides in its inherent tendency to retain the base member in its mounted position temporarily, even in the absence of the positive locking action of the wire element 22. This is described in more detail in my copending application Ser. No. 117,459, and forms the basic subject matter of that application.

In order to mount the device of FIGS. 1-4, the wire merchandise support element 22 is separated from its plastic base 10, and the base alone is mounted on the panel board, substantially in the manner reflected in FIG. 3. The flexibility of the integral tongue 27 allows it to be deflected sufficiently to permit mounting of the base, after which its resilience and memory enables it to temporarily retain the base in position. Thereafter, the wire element is inserted into the socket 20, 21 in the base, until the orientation lug 24 seats against the bottom of the slot 21. In this position, the locking lug 26 either bears against or closely confronts the flexible tongue 27, as shown in FIG. 2, to provide a positive locking action.

In a further embodiment of the invention, shown in FIGS. 5 and 6, provision is made for rigidly locking the display device in its mounted position, as in the device of FIGS. 1-4, while providing for removal of the unit by merely pivoting the wire hook to the side, rather than by physically withdrawing the hook as is done in the embodiment of FIGS. 1-4.

In the device of FIGS. 5 and 6, the merchandise support hook 122 is in all pertinent respects similar to the hook 22 shown in FIGS. 1-4, including an orientation lug 124 and a locking lug 126, as well as a vertically extending, straight mounting leg 123, which is received in a cylindrical socket 50 provided in a molded plastic base member 51. The upper portion of the molded plastic base member is provided with a semicylindrical recess 52, instead of the elongated, slot-like recess 21 of the device of FIGS. 1-4. The axis of the semicylindrical recess 52 coincides with that of the elongated cylindrical socket 50, and the radius of the recess is sufficient to enable it to receive the orientation lug 124 of the wire merchandise support. Accordingly, when the wire support 122 is installed in the base member 51, it may be pivoted about the axis of its mounting portion 123, within the limits permitted by the semicylindrical recess 52, which in the illustrated device is about 180 degrees.

As shown in the drawing, the recess 52 is provided with inwardly projecting detent ribs 53 positioned to engage the orientation lug 124 and releasably retain the wire merchandise support 122 in any of several rotational orientations, including a normal working orientation (shown in full lines in FIG. 5), disposed at 90 degress to the plane of the apertured panel board 54 and a retracted orientation (shown in FIG. 6) generally parallel to the panel board.

When the wire merchandise support 122 is oriented in its normal position, at right angles to the panel board, the locking lug portion 126 thereof either bears against or closely confronts the flexible tongue 55, which extends upwardly from the base member 51, such that the body member is rigidly locked to the panel board in the same manner as illustrated in FIGS. 1-4.

For mounting or demounting of the device of FIGS. 5 and 6, the wire merchandise support 122 is pivoted 90 degrees, to the position shown in FIG. 6. Since the pivot axis of the wire member is spaced forwardly of the flexible tongue 55, pivoting of the wire element swings the locking lug 126 forwardly, clear of the tongue 55, which is then free to flex forwardly, in the manner shown in FIG. 6. In this condition of the device, the locking tongue may be flexed sufficiently to enable the mounting lugs 57 to be inserted in or removed from the panel board openings 58 in the manner previously described.

The device of FIGS. 5 and 6 can have particular advantages in connection with preassembled display panels, for example, where the merchandise hooks are installed on the panel board sections at the merchandiser's factory and shipped to the shopkeeper in the installed condition. By orienting the wire elements in the retracted release position, the device may be readily installed on the panel board. Nevertheless, it retains a substantial self-locking feature, by reason of the inherent resilience of the tongue 55 which resists unintentional dislodgement. Accordingly, the wire element 122 may be retained in its "release" position, close to the panel board surface, for convenience in shipping, and the display may then be easily set up at the sales site by simply swinging the wire elements out to a 90 degree orientation with the panel board. In the latter orientation, the devices are positively and rigidly locked to the board.

As will be appreciated, the embodiments of FIGS. 1–6, in their illustrated forms, include a degree of redundancy in the locking features, in that the flexible locking tongues perform a self-locking function which is at least partly independent of the rigid locking feature provided by the configuration of the wire merchandise support. For most purposes, the dual locking features are useful and desirable, inasmuch as the self-locking function of the flexible locking tongue performs its primary function at times when the locking function of the wire merchandise support is not in use. For some purposes, however, it may be adequate to rely exclusively on the locking function of the wire merchandise support element 22 or 122. In such cases, it is appropriate to eliminate altogether the flexible locking tongue and permit the locking lug section of the wire member to bear directly upon or closely confront the front surface of the panel board. Where marring of the surface of the panel board might be a problem, a further alternative is to provide for a protective tongue, similar to the flexible tongues 27, 55 but not necessarily having characteristics adequate to provide self-locking action. Such a tongue would be interposed between the wire element and the surface of the panel board merely to provide a protective shield. In general, however, since the integral, resilient locking tongue may be provided on the device with such an insignificant cost addition, it would generally be more desirable to provide the locking tongue with reasonable resilience and memory and realize its full advantages as set forth in my beforementioned copending application.

Referring now to FIGS. 7–9 of the drawings, there is shown a further modification of the invention, in which a body portion 70 is formed of a unitary stamping of sheet metal material, such as spring steel, for example. Out of the single sheet of spring steel material, integral mounting lugs 71, 72 of conventional L-shaped configuration, are formed at the rear. A flat body plate 73 extends downward from the mounting lugs 71, 72 and joins with a forwardly extending lower flange 74. Between the mounting lug 71, 72, there is also formed a forwardly extending upper flange 75, which is spaced a short distance above the lower flange 74.

The upper and lower flanges 74, 75 are provided with aligned openings 76, 77, which form bearings for the reception of a vertical portion 78 of a wire-like merchandise supporting element 79. The vertical portion 78 is joined at its upper end by a bent orientation lug 80 arranged to be received in a slot-like opening 81 provided in a spring detent tab 82 which extends upwardly from the upper flange 75. When the wire-like supporting element 79 is rotated about the axis of the vertical portion 76, the orienting lug 80 displaces the detent tab 82 sufficiently to allow the lug 80 to be received in the opening 81. This effectively locks the wire-like element in its normal, operative position, with the merchandise supporting section 83 thereof extending outward from the display panel 84, typically at a 90 degree angle.

As reflected in the drawing, the wire-like merchandise support element 79 is provided with a rearwardly directed locking lug portion 85, which is arranged, when the element is in its normal or operative position, to either contact or closely confront the front surface 86 of the display panel. The region of contact or confrontation is well above the level of the panel board openings 87 through which the mounting lugs 71, 72 extend in the display panel. Accordingly, when the wire-like element is oriented in its operative position, the display hook is positively locked in its mounted position on the display panel.

For mounting or demounting of the device of FIGS. 7–8, the wire-like merchandise support member is pivoted to a retracted or release position, with the merchandise support portion 83 more or less parallel to the plane of the display panel 84. In this position, there is sufficient clearance space between the wire-like element and the front surface 86 of the display panel to accommodate the necessary tilting motion of the base member and locking lugs for mounting or demounting operations. Once the base member is in the mounted position, the wire-like element is pivoted back to its normal position, in which it is held by the detent tab 82.

The device of FIGS. 7–9 is of an extremely simplified and economical nature, capable of high speed, mass production at sufficiently low cost as to be suitable for single use applications. Where single use applications are contemplated, it is generally not required to provide for cosmetic protection of the front surface of the panel board, and it is therefore unnecessary to provide for a tongue or similar member to be interposed between the locking lug portion 85 and the front surface of the panel board.

If desired, the geometry of the base member and merchandise support member of the unit of FIGS. 7–9 may be such that, when the wire member is pivoted to its release position, the clearances are such as to require at least a slight degree of deflection of the mounting lugs and/or wire support, in order to mount or demount the unit. This will provide, to some degree, a self-locking characteristic to the device, to prevent accidental dislodgement when the wire merchandise support element is in its release position.

Figure 10:
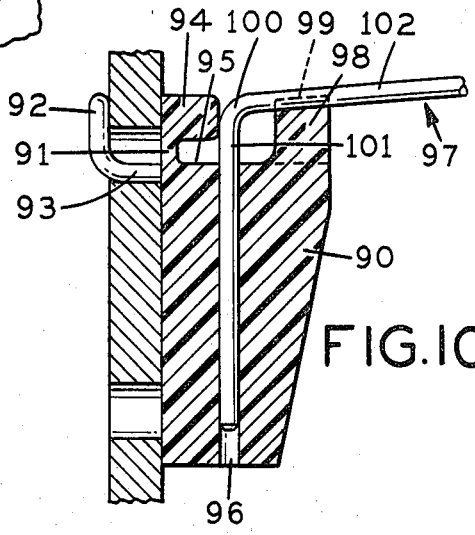
FIG. 10 is a perspective view, partly in section of a further modified form of the invention.

In the modification of FIG. 10, a plastic base member 90 is provided with an integral, upwardly extending flexible tongue 91, which is generally opposite a pair of L-shaped mounting lugs 92. At a level somewhat above the base portions 93 of the lugs, and preferably along the upper edge of the tongue 91, the tongue is provided with a forwardly projecting abutment flange portion 94, which extends forwardly over the top 95 of the base member.

The base member 90 is provided with a cylindrical recess 96 for the reception of a wire-like merchandise support element 97. Along its forward edge area, the base member 90 is provided with an upwardly extending flange 98 provided with an orientation notch 99 for the reception of a forwardly extending portion 102 of the wire merchandise support.

In use, the device of FIG. 10 functions in substantially the same manner as the device of FIG. 1. However, whereas the merchandise support element of the FIG. 1 device is provided with a rearwardly displaced loop 26, arranged to bear against the flexible tongue, the merchandise support element 97 of the FIG. 10 device may extend straight up from the recess 96 to its forward bend 100, located slightly above the abutment flange 94. The configuration of the flange 94 is such that it extends sufficiently close to the upwardly extending portion 101 of the merchandise hook as to prevent unintentional removal of the base member 90 from its mounted position on an apertured panel, whenever the wire merchandise support element is in its mounted position. For mounting or demounting of the base member 90, the merchandise support element 97 is removed, which permits resilient flexing of the tongue 91 in the manner previously described.

In any of its forms, the device of the invention provides for a highly simplified, economical yet extremely effective form of positive locking means for securing a merchandise display hook to a perforated panel display. The device of the invention does not, however, require additional component parts to be incorporated into an otherwise simple form of merchandise display hook. Rather, the positive locking feature is derived from the specific geometry of the merchandise support element. When in the normal display position, the merchandise support element has a portion contacting or closely confronting the display panel, at a location somewhat above the panel board apertures in which the device is supported on the panel board. Mounting and demounting of the device requires the wire merchandise support to either be bodily removed from its base member, or oriented to a release position. In either case, unintended or accidental dislodgement of the device from its display position is effectively positively prevented.

Importantly, the device of the present invention accomplishes its functional objectives without significant increase in manufacturing cost. This is of substantial commercial significance, because articles of this nature are generally marketed on an extremely cost-competitive basis.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In a merchandise display device of the type having a base member, panel engaging lugs extending rearwardly and upward from the upper back edge area of said base member, and merchandise support means extending forwardly from said base member, the improvement which comprises (a) said merchandise support means comprising a wire-like member movably mounted on said base member, (b) said wire-like member having locking portions adapted to closely confront or bear upon the front face of a display panel, at a level above the upper back edge of said base section, to provide substantially positive locking of said display device to said panel board.

2. A merchandise display device according to claim 1, further characterized by (a) a resilient, flexible tongue extending upwardly from the upper back edge of said base member and adapted to overlie the front surface of a perforated panel board opposite the locking portions of said wire-like member.

3. A merchandise display device according to claim 2, further characterized by (a) said base member being molded of a plastic material having properties of resilience, (b) said tongue being molded integrally with said base member.

4. A merchandise display device according to claims 1 or 2, further characterized by (a) said wire-like member being mounted for pivoting movement between a working position generally at right angles to a panel board and a release position generally parallel thereto, (b) the locking portion of said wire-like member comprising a rearwardly projecting element engageable with or closely confronting said display panel in the working position of said wire-like element and retractable to a release position removed forwardly of the display panel in the release position of the wire-like element.

5. A merchandise display device according to claims 1 or 2, further characterized by (a) said base member being formed of a one-piece stamping of sheet metal material and having a pair of mounting lugs and upper and lower flanges, (b) said wire-like member being supported in said flanges.

6. A merchandise display device according to claim 5, further characterized by (a) said wire-like member being supported in said flanges for pivoting movement, and (b) said base member including an integral, resilient detent tab for releasably retaining said wire-like member in a predetermined pivoted position.

7. In a merchandise display device of the type having a base member, panel engaging lugs extending rearwardly and upward from the upper back edge of said base member, and merchandise support means extending forwardly from said base member, the improvement which comprises (a) said merchandise support being movable relative to said base member between operative positions and release positions, (b) said merchandise support, when in its operative positions, having portions confronting a display and on which said display device is mounted at a location above said panel engaging lugs, whereby to effectively positively lock said base member against upward tilting motion sufficient to enable said base member to be de-mounted from said panel board.

8. A merchandise display device according to claim 7, further characterized by (a) said merchandise support being bodily removable from said base member to its release position.

9. A merchandise display device according to claim 7, further characterized by (a) said merchandise support being movable in said base member between operative and release positions.

10. A merchandise display device according to claim 9, further characterized by (a) said merchandise support being pivotally movable in said base member between operative and release positions.

11. A merchandise display device according to claim 7, further characterized by (a) said base member including a tongue extending upward and interposed between said confronting portions and said display panel.

12. A merchandise display device according to claim 11, further characterized by (a) said tongue being resiliently supported by said base member whereby to resiliently resist upward tilting of a mounted base member independently of said confronting portions.

13. A merchandise display device according to claim 11, further characterized by (a) said tongue having a forwardly extending abutment flange at a location spaced above said base member, and (b) said merchandise support having a portion extending upward from said base member to at least the level of said abutment flange and passing in front of said flange, (c) said abutment flange and the upwardly extending portion of said merchandise support cooperating to lock said base member against sufficient upward tilting to enable said base member to be demounted from said panel board.

* * * * *